US006405782B1

(12) United States Patent
Cheng

(10) Patent No.: US 6,405,782 B1
(45) Date of Patent: Jun. 18, 2002

(54) TRANSMISSION SYSTEM FOR A MOTOR-DRIVEN BLIND

(76) Inventor: Keng Mu Cheng, 12F-1, No. 83, Hoping East Road, Sec. 1, Taipei (TW)

( * ) Notice: Subject to any disclaimer, the term of this patent is extended or adjusted under 35 U.S.C. 154(b) by 0 days.

(21) Appl. No.: 09/713,259

(22) Filed: Nov. 16, 2000

(51) Int. Cl.[7] ..... E06B 9/36

(52) U.S. Cl. ..... 160/168.1 P; 160/176.1 P; 74/89.28; 74/665 S; 74/421 A; 74/421 R; 49/118; 49/362

(58) Field of Search ..... 160/168.1 P, 168.1 V, 160/173 V, 178.1 V, 118, 119, 343; 49/116, 118, 362; 74/89.28, 665 S, 421 A, 421 R, FOR 89

(56) References Cited

U.S. PATENT DOCUMENTS 1,355,152 A * 10/1920 Laird
1,748,948 A * 3/1930 Gassen
2,848,045 A * 8/1958 Bennett
2,853,793 A * 9/1958 Ripp et al.
3,003,552 A * 10/1961 Eilenberger
3,208,507 A * 9/1965 Breen
3,789,905 A * 2/1974 Saito
4,449,564 A * 5/1984 Hansen et al.
4,773,464 A * 9/1988 Kobayashi
4,878,528 A * 11/1989 Kobayashi
5,893,236 A * 4/1999 Krbec et al.
6,024,156 A * 2/2000 Chu
6,032,416 A * 3/2000 Springer et al.

FOREIGN PATENT DOCUMENTS

JP 406300105 * 10/1994
SU 1821599 * 3/1993

* cited by examiner

*Primary Examiner*—Blair M. Johnson

(57) ABSTRACT

A transmission system installed in the track of a motor-driven blind and controlled to move vertical slats of the motor-driven blind between a received position and an extended position and to rotate the vertical slats in regulating the light after the vertical slats have been moved to the extended position. The transmission system includes a first power drive controlled to rotate the vertical slats to the desired angle through a transmission shaft and worm and worm gear sets, and a second power drive controlled to move the vertical slats from the ends of the track toward the middle or from the middle of the track toward the ends between the extended position and the received position through two reversed screws.

9 Claims, 8 Drawing Sheets

TRANSMISSION SYSTEM FOR A MOTOR-DRIVEN BLIND

BACKGROUND OF THE INVENTION

The present invention relates to blinds for regulating the light and, more specifically, to a transmission system for a motor-driven blind, which is operated to move vertical slats toward the center area or two sides between the extended position and the extended position.

In order to eliminate the drawback of manual operation, various blinds with motor-driven transmission system have been disclosed. FIGS. 1 and 2 illustrate a blind with a motor-driven transmission mechanism according to the prior art. As illustrated, the blind 10 comprises a first power drive 12 and a second power drive 23 reversely disposed at two ends of the top track 11. The first power drive 12 comprises a motor 13, a belt transmission mechanism 14, an axle 15 coupled to the motor 13 through the belt transmission mechanism 14, a transmission gear train 16, a transmission shaft 17 coupled to the belt transmission mechanism 14 through the transmission gear train 16, a worm 19 supported in carriers 18 and coupled to the transmission shaft 17, and a worm gear 20 meshed with the worm 19 and driven by the worm 19 to rotate respective hooks 21 and the vertical slats 22 at the hooks 21 forwards/backwards within a limited angle. The second power drive 23 comprises a motor 24, a belt transmission mechanism 25, an axle 26 coupled to the motor 24 through the belt transmission mechanism 25, a transmission gear train 27, and a lead screw 28 inserted through the carriers 18 and threaded into a nut 29 in the first carrier and coupled to the belt transmission mechanism 25 through the transmission gear train 27. Upon rotary motion of the lead screw 28, the first carrier is caused to move along the lead screw 28. The carriers 18 are coupled to one another by link means 30, so that the carriers 18 are moved one after another in one direction to receive or extend out the vertical slats 22 upon rotary motion of the lead screw 28. Therefore, when the motor 24 is turned in one direction, the slats 22 are extended out. On the contrary, when the motor 24 is turned in the reversed direction, the slats 22 are received together. This structure of the blind is functional. However, the slats 22 can only be moved from the left (right) side to the right (left) side to the extended or received position, i.e., the slats 22 cannot be moved from two sides toward the center area to the extended position, or from the center area toward the two sides to the received position. In a big scale blind, moving the slats between the received position and the extended position takes much time and consumes much power supply. Further, because the slats are moved in same direction, the motion of the slats is not symmetrical, i.e., the motion of the slats is not visually harmony.

SUMMARY OF THE INVENTION

The present invention has been accomplished under the circumstances in view. It is the main object of the present invention to provide a transmission system for a motor-driven blind, which is operated to move vertical slats toward the center area or two sides between the extended position and the received position. According to one aspect of the present invention, the transmission system is installed in the track of a motor-driven blind and controlled to move vertical slats of the motor-driven blind between a received position and an extended position and to rotate the vertical slats in regulating the light after the vertical slats have been moved to the extended position. According to another aspect of the present invention, the transmission system includes a first power drive controlled to rotate the vertical slats to the desired angle through a transmission shaft and worm and worm gear sets, and a second power drive controlled to move the vertical slats from the ends of the track toward the middle or from the middle of the track toward the ends between the extended position and the received position through two reversed screws.

DETAILED DESCRIPTION OF THE PREFERRED EMBODIMENT

Figure 1:
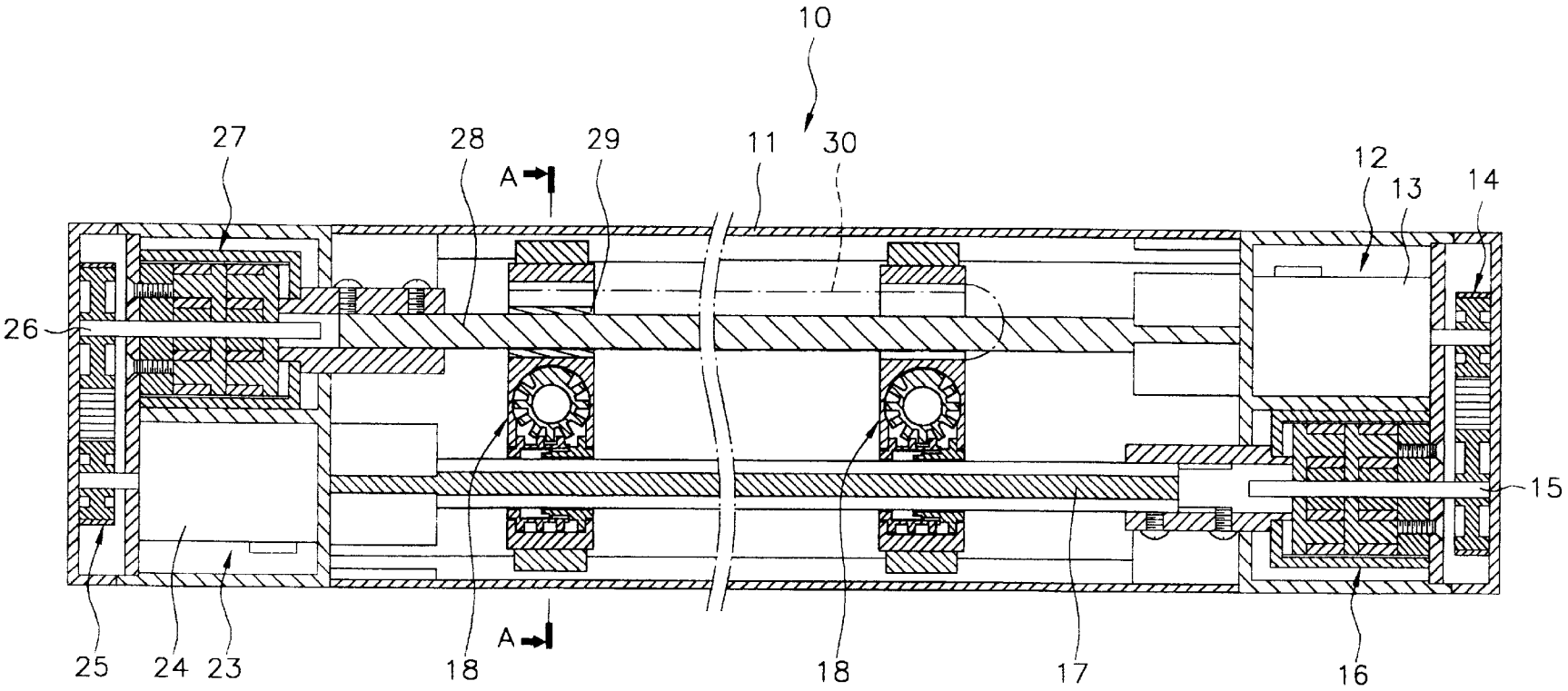
FIG. 1 (Prior Art)
FIG. 1 is a sectional view in axial direction of a motor-driven blind-according to the prior art.
Figure 2:
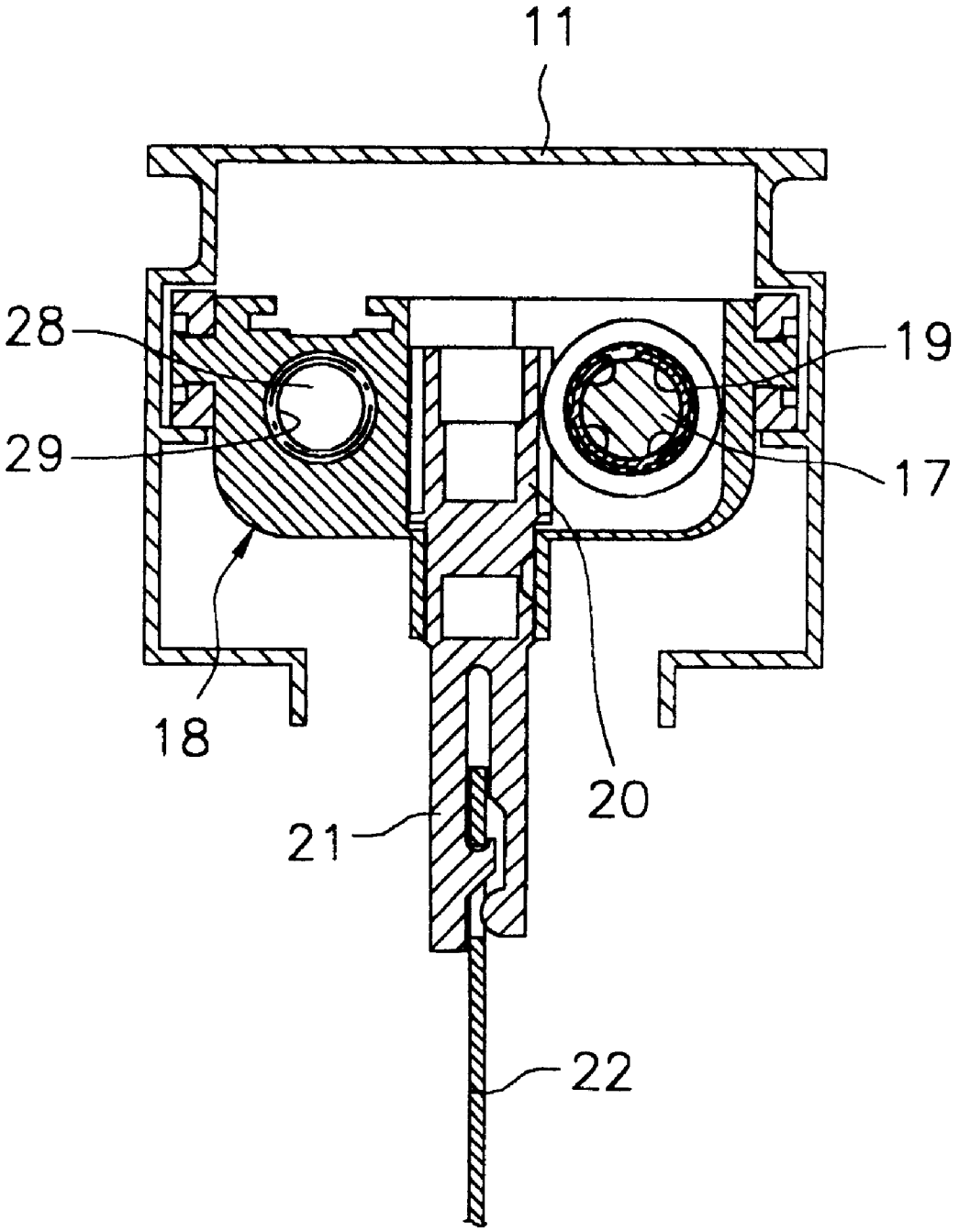
FIG. 2 (Prior Art)
FIG. 2 is a sectional view taken along line A—A of FIG. 1.
Figure 3:
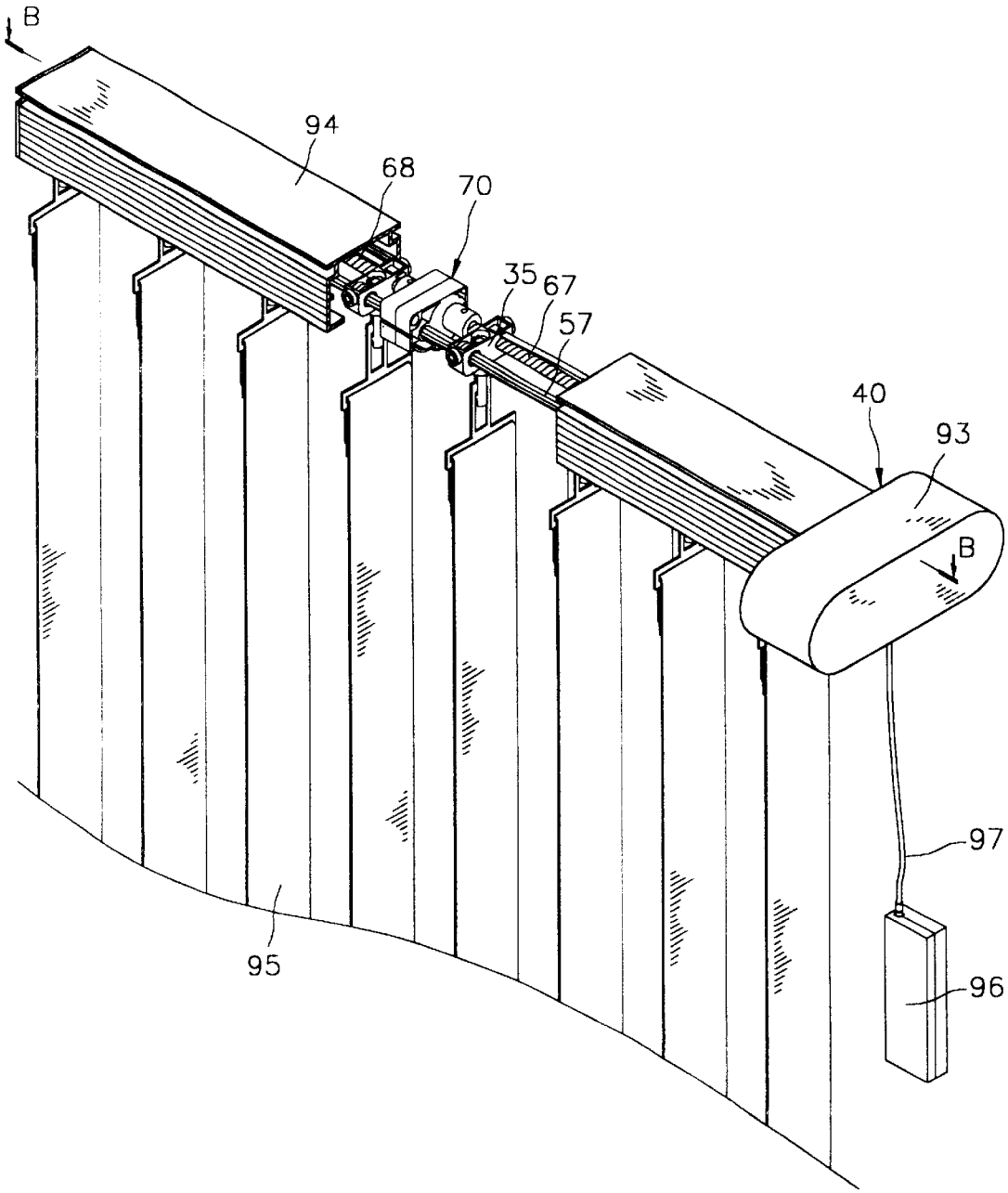
FIG. 3 is a perspective view showing a transmission system installed in a blind according to the present invention.

Referring to FIGS. from 3 through 6, a transmission system 40 in accordance with the present invention is shown comprising a first power drive 50 and a second power drive 60 respectively mounted in an end box 93 at one end of the track 94 of a blind. The first power drive 50 comprises a motor 51 having an output shaft 52, a pinion 53 fixedly mounted on the output shaft 52 of the motor 51, a gear train 54, the gear train 54 including a first gear 55 meshed with the pinion 53 to receive force of rotation from the pinion 53 and a last gear 56 for output of force of rotation, and a transmission shaft 57 coupled to the last gear 56 of the gear train 54. The transmission shaft 57 has a front end directly coupled to the last gear 56 of the gear train 54, and a rear end supported in the track 94. The carriers 35 are slidably supported on the transmission shaft 57, each comprising a worm 36 mounted in the carriers 35, and a worm gear 37 meshed with the worm 36. The vertical slats 95 of the blind are respectively suspended from the hook 38 at the worm gear 37 of each carrier 35. When rotating the transmission shaft 57, the worm 36 in each carrier 35 is driven to rotate the respective worm gear 37 with the respective hook 38, and therefore the vertical slats 95 rotated within a limited angle (about 183°) to regulate the light. Because this technique is of the known art, no further description is necessary.

Referring to FIGS. 4 and 5 again, the second power drive 60 comprises a motor 61 having an output shaft 62, a pinion 63 fixedly mounted on the output shaft 62 of the motor 61, a gear train 64, the gear train 64 including a first gear 65 meshed with the pinion 63 to receive force of rotation from the pinion 63 and a last gear 66 for output of force of rotation, a drive screw 67 coupled to the last gear 66 of the gear train 64, a driven screw 68, and a coupler 70 coupled between the drive screw 67 and the driven screw 68. The carriers 35 (vertical slats 95) are arranged in two sets respectively supported on the drive screw 67 and the driven screw 68. When rotating the driven screw 67 in one direction, the driven screw 68 is rotated in the reversed direction, thereby causing the two sets of carriers 35 to move toward the center area of the track 94 to the extended position, or the lateral sides to the received position (this will be explained further).

The aforesaid gear trains 54 and 64 use pairs of gears to transmit force of rotation one after another, so as to reduce the velocity of rotation and to increase the torque. According to the present preferred embodiment, each gear train uses four pairs of gears. The motors 51 and 61 obtain power supply from a set of battery cells. The battery cells are installed with an electronic control circuit, which controls the operation of the motors 51 and 61, in a control box 96. The control box 96 is connected to the motors 51 and 61 through an electric wire 97. The control box 96 has a control panel for operation control. A remote controller may be provided for controlling the electronic control circuit of the control box at a far place. This wired or wireless control technique is of the known art and not within the scope of the present invention.

Figure 4:
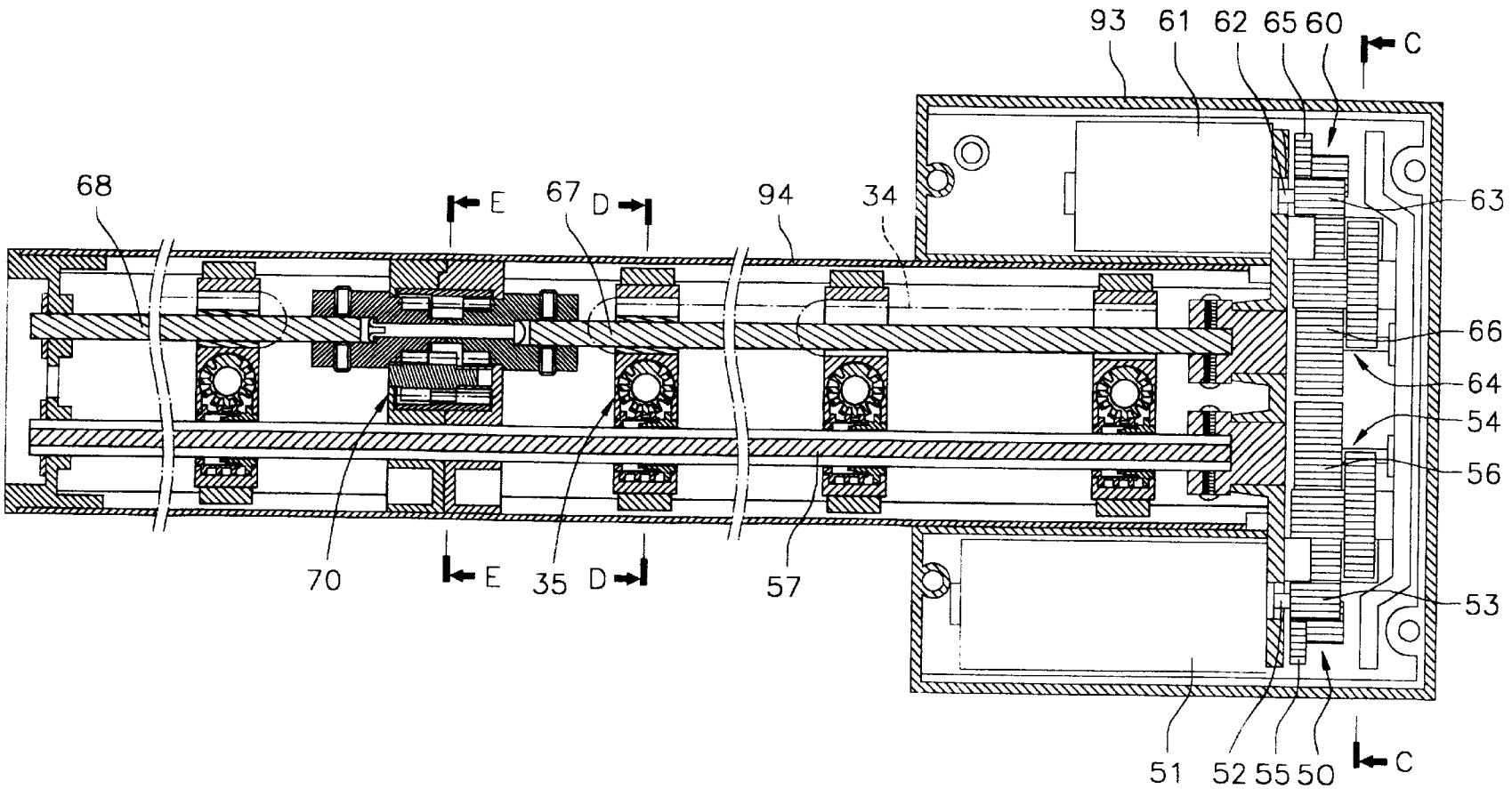
FIG. 4 is a sectional view taken along line B—B of FIG. 3.
Figure 5:
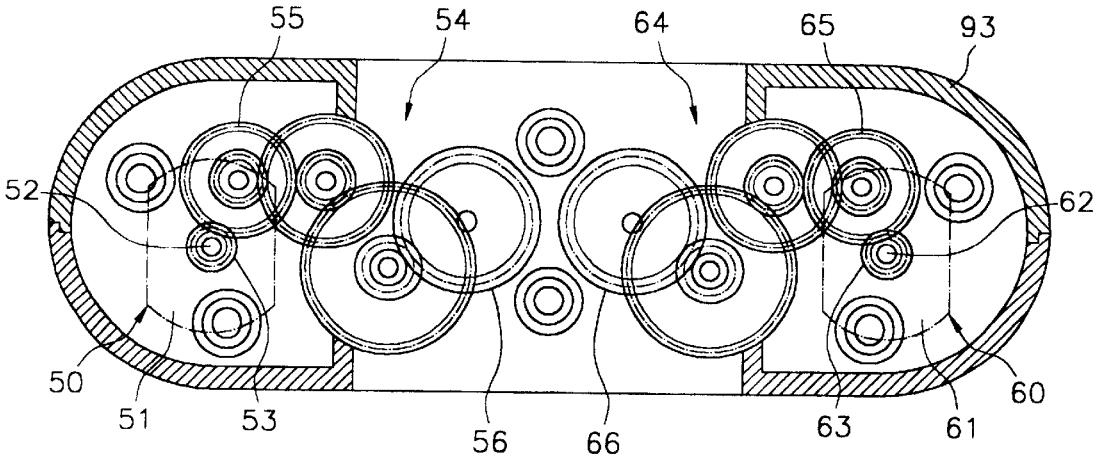
FIG. 5 is a sectional view taken along line D-C of FIG. 4.

Referring to FIG. 4, the drive screw 67 and the driven screw 68 have the same threading direction, and are connected to the coupler 70 at two sides for synchronous rotation in reversed directions.

Figure 9:
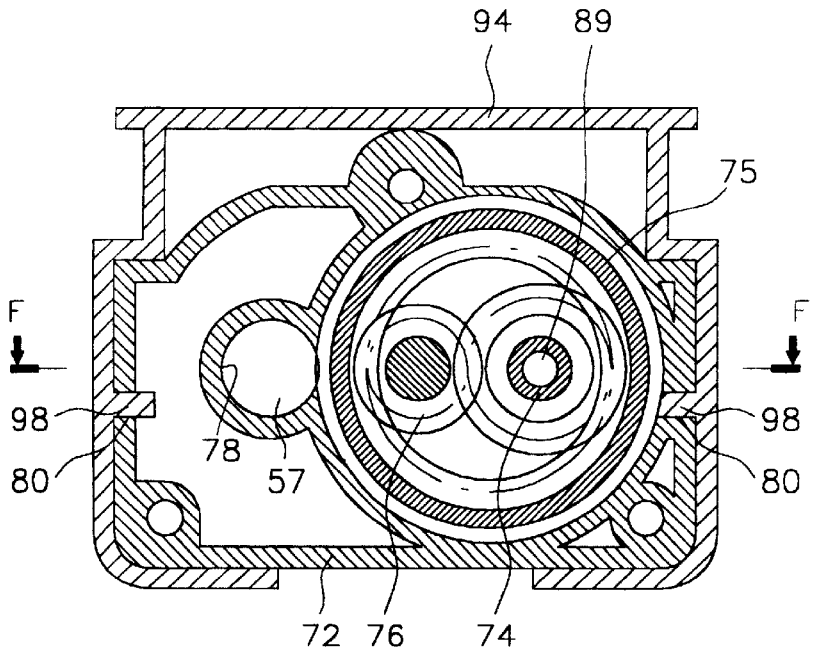
FIG. 9 is a sectional view taken along line E—E of FIG. 4.

Referring to FIGS. from 7 through 10, the coupler 70 comprises two symmetrical base blocks, namely, the first base block 71 and the second base block 72, a drive gear 73, a driven gear 74, an internal gear 75, and an idle gear 76. The base blocks 71 and 72 are fixedly fastened together face to face by screws (not shown), each comprising an axle hole 77 or 78 for the passing of the transmission shaft 57 of the first power drive 50, so that the two distal ends and middle part of the transmission shaft 57 are well supported, two side grooves 79 or 80 disposed at two sides and respectively coupled to the two longitudinally extended, opposite inside coupling ribs 98 of the track 94 to hold the coupler 70 positively in the track 94 as shown in FIG. 9, an opening 81 or 82, which receives the drive gear 73 or the driven gear 74, and a mounting hole 91 or 92 disposed in axial alignment with the opening 81 or 82, which receives the internal gear 75. The drive gear 73 and the driven gear 74 are identical, each comprising a stepped axial center through hole 83 or 84, and a radial screw hole 85 or 86 extended across the stepped axial center through hole 83 or 84. The stepped axial center through hole 83 of the drive gear 73 receives the rear end of the drive screw 67 (the front end of the drive screw 67 is directly coupled to the last gear 66 of the gear train 64 of the second power drive 60). After insertion of the rear end of the drive screw 67 into the stepped axial center through hole 83 of the drive gear 73, two holding down screws 87 are respectively threaded into the radial screw holes 85 to hold down the drive screw 73. The stepped axial center through hole 84 of the driven gear 74 receives the front end of the driven screw 68 (the rear end of the driven screw 68 is supported in the track 94). After insertion of the front end of the driven screw 68 into the stepped axial center through hole 84 of the driven gear 74, two holding down screws 88 are respectively threaded into the radial screw holes 86 to hold down the driven screw 74. The stepped axial center through holes 83 and 84 also receive a split pin 89, which is connected between the drive gear 67 and the driven gear 68 to hold the drive gear 67 and the driven gear 68 together. The internal gear 75 is mounted in the mounting holes 91 and 92 inside the base blocks 71 and 72, and meshed with the drive gear 73 and the idle gear 76. The idle gear 76 is meshed with the internal gear 75 and the driven gear 74, having two ends respectively supported in the first base block 71 and the second base block 72.

Figure 6:
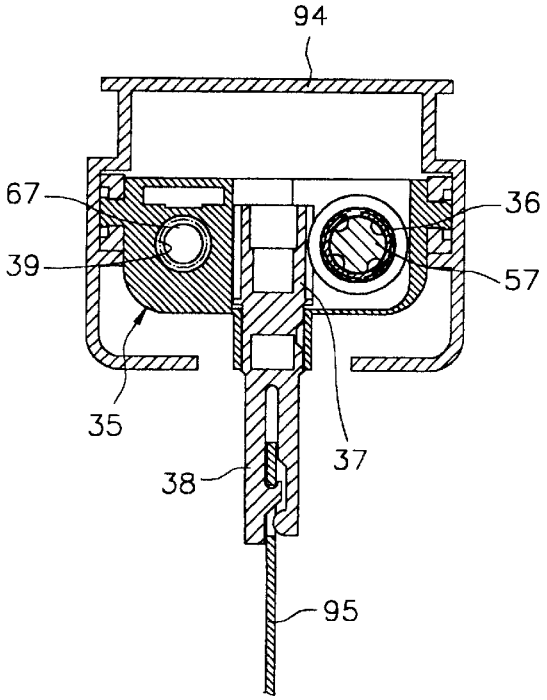
FIG. 6 is a sectional view taken along line D—D of FIG. 4.
Figure 7:
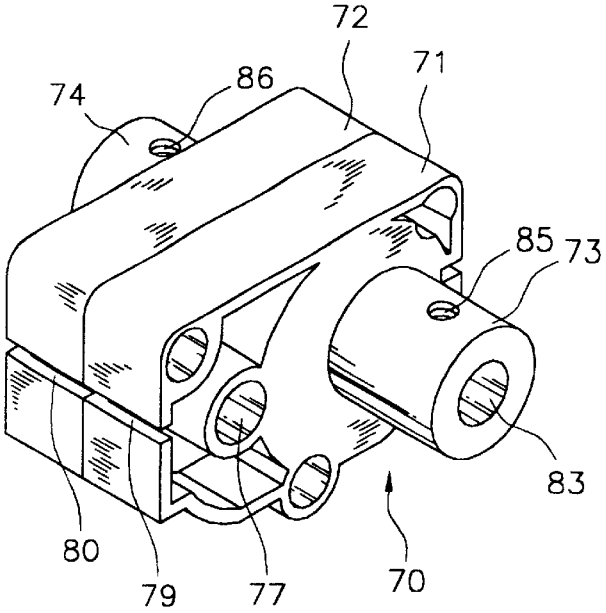
FIG. 7 is a perspective view of a coupler for the transmission system according to the present invention.
Figure 8:
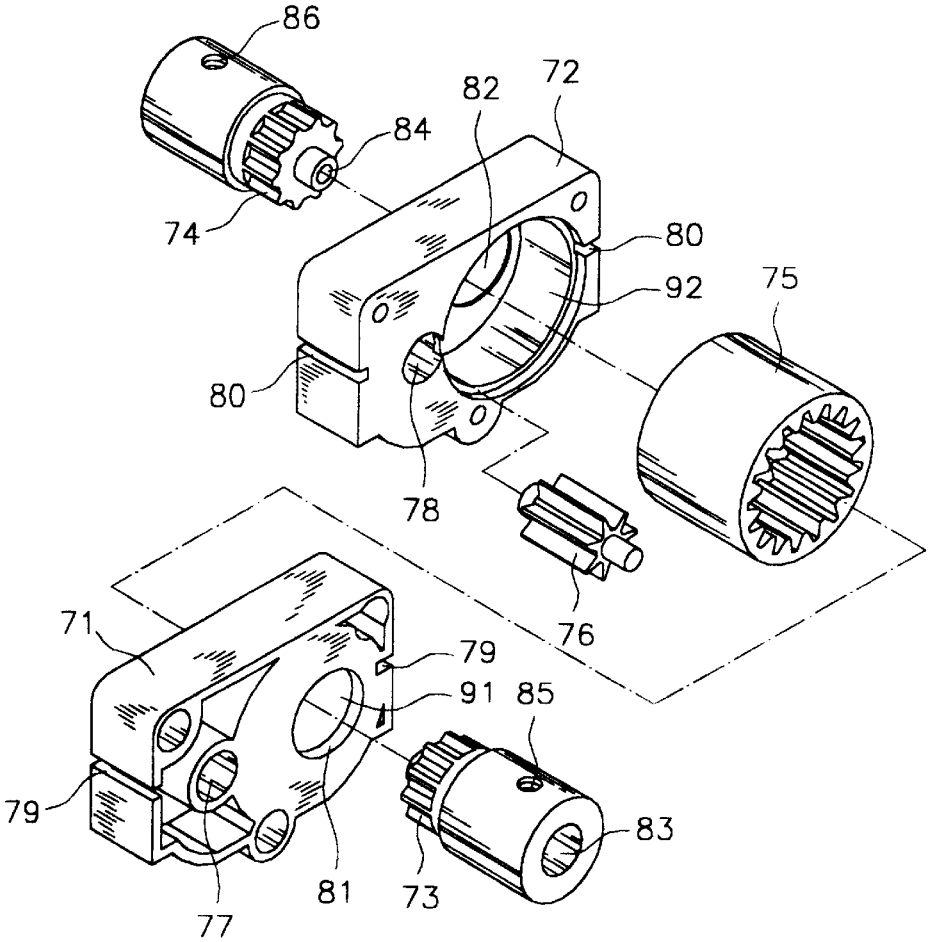
FIG. 8 is an exploded view of the coupler shown in FIG.7.
Figure 10:
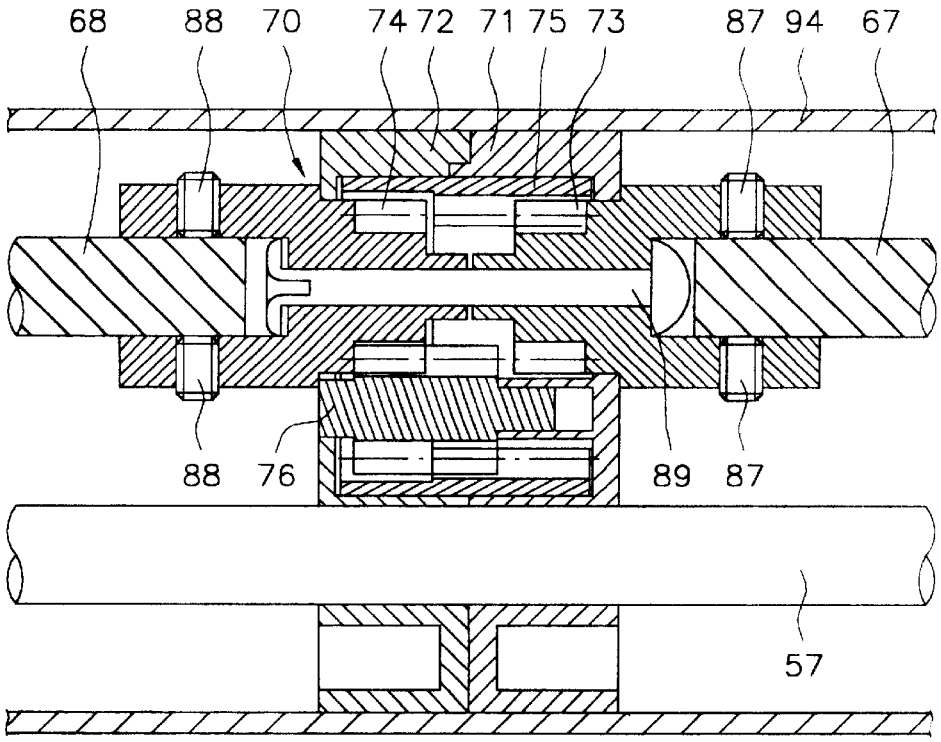
FIG. 10 is a sectional view taken along line F—F of FIG. 9.

Referring to FIG. 10 and FIGS. 4 and 6 again, when the drive screw 67 of the second power drive 60 is rotated, the drive gear 73 is driven to rotate the internal gear 75, thereby causing the internal gear 75 to rotate idle gear 76 and then the driven gear 74, and therefore the driven screw 68 is rotated in direction reversed to the drive screw 67. For example, when the drive screw 67 is rotated clockwise, the driven screw 68 is rotated counter-clockwise. As indicated above, the carriers 35 are arranged in two sets respectively mounted on the drive screw 67 and the driven screw 68. The two sets of carriers 35 each include a first carrier 35 closer to the coupler 70. The two first carriers 35 each comprise a nut 39 threaded onto the drive screw 67 or the driven screw 68 (see FIG. 6). Therefore, during reverse rotary motion of the drive screw 67 and the driven screw 68, the two first carriers 35 are moved along the threads of the driven screw 67 and the driven screw 68 respectively, to further move the respective second carriers by the respective links 34. In this manner, the carriers 35 of each set of carriers are moved one after another until all carriers of the same set have been equally spaced from one another, and therefore the vertical slats 95 are symmetrically extended out from the two ends of the track 94 to the center area. On the contrary, when the drive screw 67 and the driven screw 68 are reversed, the two sets of carriers 35 are respectively moved from the center area of the track 94 to the two ends of the track 94 to the received position.

Figure 11:
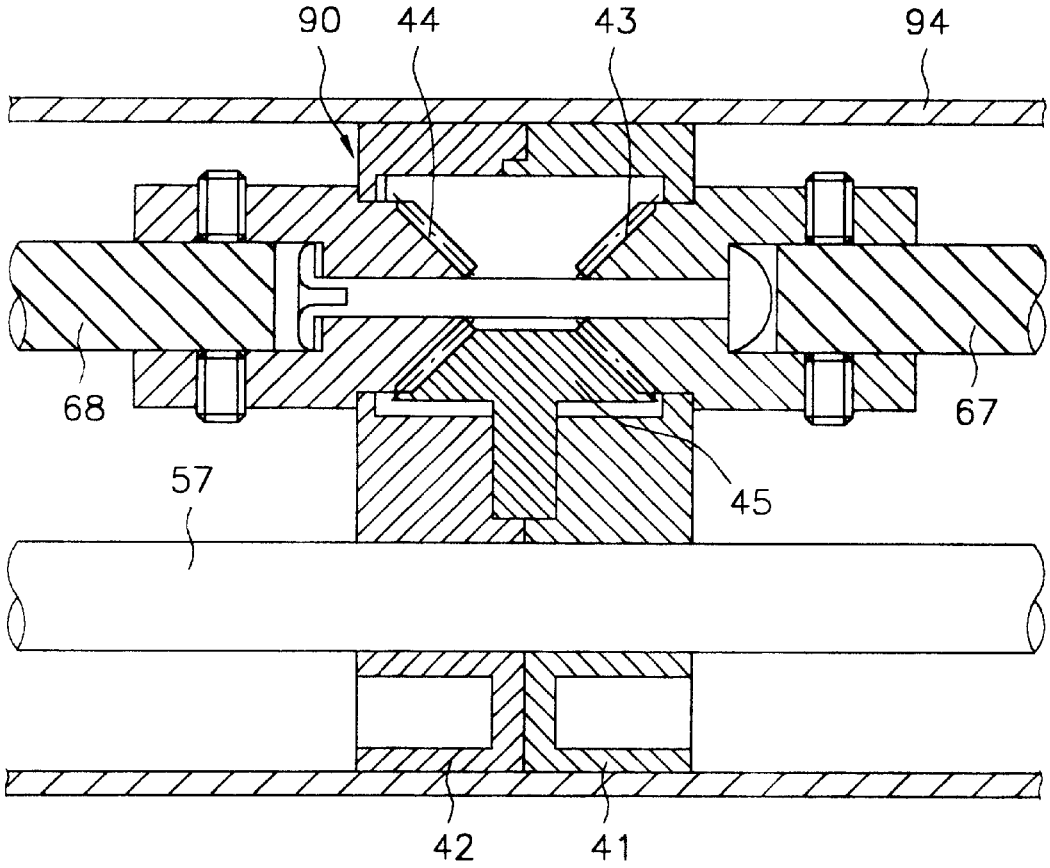
FIG. 11 is similar to FIG. 10 but showing an alternate form of coupler used and coupled between the driven screw and the driven screw.

FIG. 11 shows an alternate form of the coupler. According to this alternate form, the coupler 90 comprises a first base block 41, a second base block 42, a drive gear 43, a driven gear 44, and an idle gear 45. The structure and function of the base blocks 41 and 42 are same as the base blocks 71 and 72 of the aforesaid first embodiment. In the aforesaid first embodiment, the drive gear 73 and the driven gear 74 are spur gears. In this alternate form, the drive gear 43 and the driven gear 44 are bevel gears. The idle gear 45 is revolvably supported in the base blocks 41 and 42, and respectively meshed with the drive gear 43 and the driven gear 44. When the drive screw 67 of the second power drive 60 is rotated, the drive gear 43 is driven to rotate the idle gear 45 and then the driven gear 44, and therefore the driven screw 68 is rotated by the driven gear 44 in direction reversed to the direction of rotation of the drive screw 67. Further, if the drive screw 67 and the driven screw 68 have different threading directions, for example, if the drive screw 67 is right screw and the driven screw 68 is a left screw; the drive gear 43, the driven gear 44 and the idle gear 45 should be spur gears.

It is to be understood that the drawings are designed for purposes of illustration only, and are not intended for use as a definition of the limits and scope of the invention disclosed.

What the invention claimed is:

1. A transmission system installed in the track of a motor-driven blind and controlled to move vertical slats of the motor-driven blind between a received position and an extended position and to rotate the vertical slats in regulating the light after the vertical slats have been moved to the extended position; the transmission system comprising:

a first power drive, said first power drive comprising a motor having an output shaft, a pinion fixedly mounted on the output shaft of the motor of said first power drive, and a gear train, the gear train of said first power drive including a first gear meshed with the pinion of said first power drive, and a last gear;

a transmission shaft rotatably supported in the track of the motor-driven blind, said transmission shaft having a front end fixedly connected to the last gear of the gear train of said first power drive and a rear end supported in the track of the motor-driven blind;

a second power drive, said second power drive comprising a motor having an output shaft, a pinion fixedly mounted on the output shaft of the motor of said second power drive, and a gear train, the gear train of said second power drive including a first gear meshed with the pinion of said second power drive, and a last gear;

a drive screw, said drive screw having a front end fixedly connected to the last gear of the gear train of said second power drive and a rear end;

a driven screw, said driven screw having a rear end supported in a part of the track of the motor-driven blind and a front end;

a coupler coupled between the rear end of said drive screw and the front end of said driven screw for enabling said driven screw to be rotated upon rotary motion of said drive screw; and wherein said coupler comprises:

a first base block, said base block comprising an axle hole for the passing of said transmission shaft; a second base block fixedly fastened to said first base block, said second base block comprising an axle hole aligned with the axle hole of said first base block for the passing of said transmission shaft; a drive gear revolvably mounted in said first base block, said drive gear comprising an axial through hole, which receives the rear end of said drive screw, at least one screw hole perpendicularly disposed in communication with the axial through hole of said drive gear, and at least one holding down screw respectively threaded into the at least one screw hole of said drive gear to hold down the rear end of said drive screw; a driven gear revolvably mounted in said second base block, said driven gear comprising an axial through hole, which receives the front end of said driven screw, at last one screw hole perpendicularly disposed in communication with the axial through hole of said driven gear, and at least one holding down screw respectively threaded into the at least one screw hole of said driven gear to hold down the front end of said driven screw; an idle gear revolvably mounted in between said first base block and said second base block and meshed with said driven gear; an internal gear revolvably mounted in between said first base block and said second base block and meshed with said drive gear and said idle gear.

2. The transmission system of claim 1, wherein said first base block and said second base block each comprise two coupling grooves disposed at two sides adapted for coupling to respective inside coupling ribs of the track of the motor-driven blind.

3. The transmission system of claim 1 further comprising a split pin mounted in the axial through hole of said drive gear and the axial through hole of said driven gear and connected between the rear end of said drive screw and the front end of said driven screw.

4. A transmission system installed in the track of a motor-driven blind and controlled to move vertical slats of the motor-driven blind between a received position and an extended position and to rotate the vertical slats in regulating the light after the vertical slats have been moved to the extended position, the transmission system comprising:

a first power drive, said first power drive comprising a motor having an output shaft, a pinion fixedly mounted on the output shaft of the motor of said first power drive, and a gear train, the gear train of said first power drive including a first gear meshed with the pinion of said first power drive, and a last gear;

a transmission shaft rotatably supported in the track of the motor-driven blind, said transmission shaft having a front end fixedly connected to the last gear of the gear train of said first power drive and a rear end supported in the track of the motor-driven blind;

a second power drive, said second power drive comprising a motor having an output shaft, a pinion fixedly mounted on the output shaft of the motor of said second power drive, and a gear train, the gear train of said second power drive including a first gear meshed with the pinion of said second power drive, and a last gear;

a drive screw, said drive screw having a front end fixedly connected to the last gear of the gear train of said second power drive and a rear end;

a driven screw, said driven screw having a rear end supported in a part of the track of the motor-driven blind and a front end;

a coupler coupled between the rear end of said drive screw and the front end of said driven screw for enabling said driven screw to be rotated upon rotary motion of said drive screw; and wherein said drive screw and said driven screw have same threading direction.

5. A transmission system installed in the track of a motor-driven blind and controlled to move vertical slats of the motor-driven blind between a received position and an extended position and to rotate the vertical slats in regulating the light after the vertical slats have been moved to the extended position, the transmission system comprising:

a first power drive, said first power drive comprising a motor having an output shaft, a pinion fixedly mounted on the output shaft of the motor of said first power drive, and a gear train, the gear train of said first power drive including a first gear meshed with the pinion of said first power drive, and a last gear;

a transmission shaft rotatably supported in the track of the motor-driven blind, said transmission shaft having a front end fixedly connected to the last gear of the gear train of said first power drive and a rear end supported in the track of the motor-driven blind;

a second power drive, said second power drive comprising a motor having an output shaft, a pinion fixedly mounted on the output shaft of the motor of said second power drive, and a gear train, the gear train of said second power drive including a first gear meshed with the pinion of said second power drive, and a last gear;

a drive screw, said drive screw having a front end fixedly connected to the last gear of the gear train of said second power drive and a rear end;

a driven screw, said driven screw having a rear end supported in a part of the track of the motor-driven blind and a front end;

a coupler coupled between the rear end of said drive screw and the front end of said driven screw for enabling said driven screw to be rotated upon rotary motion of said drive screw; and wherein said coupler comprising:

a first base block said base block comprising an axle hole for the passing of said transmission shaft; a second base block fixedly fastened to said first base block, said second base block comprising an axle hole aligned with the axle hole of said first base block for the passing of said transmission shaft; a drive gear revolvably mounted in said first base block, said drive gear comprising an axial through hole, with receives the rear end of said drive screw, at least one screw hole perpendicularly disposed in communication with the axial through hole of said drive gear, and at least one holding down screw respectively threaded into the at least one screw hole of said drive gear to hold down the rear end of said drive screw; a driven gear revolvably mounted in said second base block, said driven gear comprising an axial through hole, which receives the front end of said driven screw, at least one screw hole perpendicularly disposed in communication with the axial through hole of said driven gear, and at least one holding down screw respectively threaded into the at least one screw hole of said driven gear to hold down the front end of said driven screw; an idle gear revolvably mounted in between said first base block and said second base block and meshed with said drive gear and said driven gear.

6. The transmission system of claim 5, wherein said first base block and said second base block each comprise two coupling grooves disposed at two sides adapted for coupling to respective inside coupling ribs of the track of the motor-driven blind.

7. The transmission system of claim 5, wherein said drive gear, said driven gear and said idle gear are bevel gears, and said drive screw and said driven screw have same threading direction.

8. The transmission system of claim 5, wherein said drive gear, said driven gear and said idle gear are spur gears, and said drive screw and said driven screw have reversed threading directions.

9. The transmission system of claim 5 further comprising a split pin mounted in the axial through hole of said drive gear and the axial through hole of said driven gear and connected between the rear end of said drive screw and the front end of said driven screw.

* * * * *